US011361717B2

(12) United States Patent
Lee et al.

(10) Patent No.: US 11,361,717 B2
(45) Date of Patent: Jun. 14, 2022

(54) SENSING CIRCUIT, DATA DRIVER INTEGRATED CIRCUIT, DISPLAY DEVICE AND DRIVING METHOD THEREOF

(71) Applicant: LG Display Co., Ltd., Seoul (KR)

(72) Inventors: Taeyoung Lee, Paju-si (KR); KyoungDon Woo, Paju-si (KR); KyungRok Kim, Paju-si (KR); MyungGi Lim, Paju-si (KR); Jisu Choi, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 253 days.

(21) Appl. No.: 16/709,005

(22) Filed: Dec. 10, 2019

(65) Prior Publication Data

US 2020/0202796 A1 Jun. 25, 2020

(30) Foreign Application Priority Data

Dec. 21, 2018 (KR) ..... 10-2018-0167939

(51) Int. Cl.
*G09G 3/3291* (2016.01)
*G09G 3/20* (2006.01)

(52) U.S. Cl.
CPC ..... *G09G 3/3291* (2013.01); *G09G 3/2092* (2013.01)

(58) Field of Classification Search
CPC ..... G09G 3/3291; G09G 3/2092
See application file for complete search history.

(56) References Cited

U.S. PATENT DOCUMENTS 5,705,807 A * 1/1998 Throngnumchai ..... H03F 3/087 356/221
2006/0261245 A1* 11/2006 Sugiyama ..... H04N 5/345 348/E3.018
2008/0158184 A1* 7/2008 Land ..... G06F 3/0418 345/173
2011/0058082 A1* 3/2011 Tay ..... H04N 1/32491 348/308
2013/0135259 A1* 5/2013 King ..... G06F 3/0428 345/175
2018/0061329 A1* 3/2018 Lee ..... G09G 3/3241

FOREIGN PATENT DOCUMENTS

KR 10-2017-0080775 A 7/2017
KR 10-2018-0023188 A 3/2018

OTHER PUBLICATIONS

English Translation of KR 20170080775 (Year: 2017).*

* cited by examiner

*Primary Examiner* — Patrick N Edouard
*Assistant Examiner* — Eboni N Giles
(74) *Attorney, Agent, or Firm* — Morgan, Lewis & Bockius LLP

(57) ABSTRACT

A sensing circuit includes: a current source that outputs a direct current; an integrator that integrates a sensing current and the direct current, which is higher than the sensing current, to output an integrated value composed of the sum of a sensing voltage and a direct current voltage; and a subtractor that takes the sensing voltage from the integrated value outputted from the integrator, but not the direct current voltage.

16 Claims, 14 Drawing Sheets

SENSING CIRCUIT, DATA DRIVER INTEGRATED CIRCUIT, DISPLAY DEVICE AND DRIVING METHOD THEREOF

This application claims the benefit of Korea Patent Application No. 10-2018-0167939 filed on Dec. 21, 2018, which is incorporated herein by reference for all purposes as if fully set forth herein.

BACKGROUND

Technical Field

The present disclosure relates to a sensing circuit, a data driver integrated circuit, a display device, and a method of driving the same.

Discussion of the Related Art

An active-matrix organic light-emitting display comprises self-luminous organic light-emitting diodes (hereinafter, "OLED"), and has the advantages of fast response time, high luminous efficiency, high luminance, and wide viewing angle.

In an organic light-emitting display, pixels each comprising an organic light emitting diode are arranged in a matrix, and the luminance of the pixels is adjusted based on the grayscale values of video data. Each individual pixel comprises a driving TFT (thin-film transistor) that controls the drive current flowing through the OLED in response to their gate-source voltage Vgs. The amount of light emitted by the OLED is proportional to the drive current, and the brightness of display is adjusted by the amount of light emission.

The organic light-emitting display may deteriorate over time, including an increase in the threshold voltage Vth of the OLEDs and a decrease in luminous efficiency. The degree of deterioration in the OLEDs may differ for each pixel. Variation in the degree of deterioration between individual pixels causes variation in brightness and degradation in picture quality.

To solve this, there is a known technology to sense the driving characteristics of each pixel and compensate for input video data depending on the degree of deterioration. In order to compensate for current characteristics, which are pixels' driving characteristics, a sensor for sensing the driving characteristics of pixels and an analog-to-digital converter (hereinafter, "ADC") for converting analog sensing data inputted from the sensor into digital sensing data are required. However, proposed compensation technology still has room for improvement.

To overcome the aforementioned problem in the background art, the present invention is directed to enhancing low current sensing capability and eliminating or improving the effects of noise components that may be introduced during a sensing operation.

SUMMARY

Accordingly, embodiments of the present disclosure are directed to a sensing circuit, a data driver integrated circuit, a display device, and a method of driving the same that substantially obviates one or more of the problems due to limitations and disadvantages of the related art.

Features and aspects will be set forth in the description that follows, and in part will be apparent from the description, or may be learned by practice of the inventive concepts provided herein. Other features and aspects of the inventive concepts may be realized and attained by the structure particularly pointed out in the written description, or derivable therefrom, and the claims hereof as well as the appended drawings.

To achieve these and other aspects of the inventive concepts, as embodied and broadly described, a sensing circuit comprises: a current source that outputs a direct current; an integrator that integrates a sensing current and the direct current, which is higher than the sensing current, to output an integrated value composed of the sum of a sensing voltage and a direct current voltage; and a subtractor that takes the sensing voltage from the integrated value outputted from the integrator, but not the direct current voltage.

The subtractor may comprise: a first capacitor that stores the direct current voltage; a second capacitor that stores the sensing voltage and the direct current voltage; and a plurality of switches that perform a switching operation to subtract the voltages stored in the first capacitor and second capacitor.

The subtractor may comprise: a first switch, one end of which is connected to an output terminal of the integrator, and the other end of which is connected to a first electrode of the first capacitor; a second switch, one end of which is connected to the output terminal of the integrator, and the other end of which is connected to a first electrode of the second capacitor; the first capacitor, the first electrode of which is connected to the other end of the first switch and, a second electrode of which is connected to a second electrode of the second capacitor; the second capacitor, the first electrode of which is connected to the other end of the second switch, and the second electrode of which is connected to the second electrode of the first capacitor; a third switch, one end of which is connected to the second electrode of the first capacitor and the second electrode of the second capacitor, and the other end of which is connected to a first reference voltage source of the subtractor; and a fourth switch, one end of which is connected to the first electrode of the first capacitor, and the other end of which is connected to a second reference voltage source of the subtractor.

In another aspect, a data driver IC comprises: a voltage supply part that outputs a data voltage for display or a data voltage for sensing through a data channel; and a sensing circuit that senses a current through a sensing channel, the sensing circuit comprising: a current source that outputs a direct current; an integrator that integrates the sensing current and the direct current, which is higher than the sensing current, to output an integrated value composed of the sum of a sensing voltage and a direct current voltage; and a subtractor that takes the sensing voltage from the integrated value outputted from the integrator, but not the direct current voltage.

The subtractor may comprise: a first capacitor that stores the direct current voltage; a second capacitor that stores the sensing voltage and the direct current voltage; and a plurality of switches that perform a switching operation to subtract the voltages stored in the first capacitor and second capacitor.

The subtractor may comprise: a first switch, one end of which is connected to an output terminal of the integrator, and the other end of which is connected to a first electrode of the first capacitor; a second switch, one end of which is connected to the output terminal of the integrator, and the other end of which is connected to a first electrode of the second capacitor; the first capacitor, the first electrode of which is connected to the other end of the first switch and, a second electrode of which is connected to a second electrode of the second capacitor; the second capacitor, the first electrode of which is connected to the other end of the second switch, and the second electrode of which is connected to the second electrode of the first capacitor; a third switch, one end of which is connected to the second electrode of the first capacitor and the second electrode of the second capacitor, and the other end of which is connected to a first reference voltage source of the subtractor; and a fourth switch, one end of which is connected to the first electrode of the first capacitor, and the other end of which is connected to a second reference voltage source of the subtractor.

In another aspect, a display device comprises: a display panel with a plurality of pixels connected to sensing lines; and a data driver IC with sensing channels connected to the sensing lines, wherein the data driver IC comprises a sensing circuit, the sensing circuit comprising: an integrator that obtains a sensing current through at least one of the sensing channels and integrates the sensing current and a direct current, which is higher than the sensing current, to output an integrated value composed of the sum of a sensing voltage and a direct current voltage; and a subtractor that takes the sensing voltage from the integrated value outputted from the integrator, but not the direct current voltage.

The subtractor may comprise: a first capacitor that stores the direct current voltage; a second capacitor that stores the sensing voltage and the direct current voltage; and a plurality of switches that perform a switching operation to subtract the voltages stored in the first capacitor and second capacitor.

The subtractor may comprise: a first switch, one end of which is connected to an output terminal of the integrator and the other end of which is connected to a first electrode of the first capacitor; a second switch, one end of which is connected to the output terminal of the integrator, and the other end of which is connected to a first electrode of the second capacitor; the first capacitor, the first electrode of which is connected to the other end of the first switch and, a second electrode of which is connected to a second electrode of the second capacitor; the second capacitor, the first electrode of which is connected to the other end of the second switch, and the second electrode of which is connected to the second electrode of the first capacitor; a third switch, one end of which is connected to the second electrode of the first capacitor and the second electrode of the second capacitor, and the other end of which is connected to a first reference voltage source of the subtractor; and a fourth switch, one end of which is connected to the first electrode of the first capacitor, and the other end of which is connected to a second reference voltage source of the subtractor.

The first reference voltage source and the second reference voltage source may have different levels from each other.

The data driver IC may comprise: a first integrator that integrates a first direct current, sensing current, and first noise component applied through a first sensing channel to output a first direct current voltage, a sensing voltage, and a first noise voltage; a second integrator that integrates a second direct current and second noise component applied through a second sensing channel to output a second direct current voltage and a second noise voltage; a first subtractor that stores the first direct current voltage outputted during a first operation time of the first integrator in a first capacitor and stores the sum of the first direct current voltage, sensing voltage, and first noise voltage outputted during a second operation time of the first integrator in a second capacitor; and a second subtractor that stores the second direct current voltage outputted during a first operation time of the second integrator in a first capacitor and stores the sum of the second direct current voltage, sensing voltage, and second noise voltage outputted during a second operation time of the second integrator in a second capacitor.

The data driver IC may take the sensing voltage and the first noise voltage from the first and second capacitors of the first subtractor, but not the first direct current voltage, and takes the second noise voltage from the first and second capacitors of the second subtractor, but not the second direct current voltage.

The data driver IC may obtain the sensing voltage by differencing the sensing voltage and first noise voltage taken from the first subtractor and the second noise voltage.

In another aspect, a method of driving a display device comprises: integrating a first direct current applied through a first sensing channel by a first integrator to output a first direct current voltage and store the first direct current voltage outputted from the first integrator in a first capacitor of a first subtractor, and integrating a second direct current applied through a second sensing channel by a second integrator to output a second direct current voltage and store the second direct current voltage outputted from the second integrator in a first capacitor of a second subtractor; integrating the first direct current, a sensing current, and a first noise component, which are applied through the first sensing channel, by the first integrator to output the sum of the first direct current voltage, a sensing voltage, and a first noise voltage and store the sum of the first direct current voltage, sensing voltage, and first noise voltage outputted from the first integrator in a second capacitor of the first subtractor, and integrating the second direct current and a second noise component, which are applied through the second sensing channel, by the second integrator to output the second direct current voltage and a second noise voltage and store the second direct current voltage and second noise voltage outputted from the second integrator in a second capacitor of the second subtractor; and taking the sensing voltage and the first noise voltage from the first and second capacitors of the first subtractor, but not the first direct current voltage, and taking the second noise voltage from the first and second capacitors of the second subtractor, but not the second direct current voltage.

The display device may further comprise obtaining the sensing voltage by differencing the sensing voltage and first noise voltage taken from the first subtractor and the second noise voltage.

With this configuration, the present invention can enhance low-current sensing capability since a current source for applying a large current which is higher than a sensing current and a subtractor for taking only the sensing current, but not an artificially applied current, are formed inside a data driver IC. Moreover, the present invention can eliminate or improve the effects of noise components that may be introduced during a sensing operation, by differencing sensing values obtained through two channels.

It is to be understood that both the foregoing general description and the following detailed description are exemplary and explanatory and are intended to provide further explanation of the inventive concepts as claimed.

BRIEF DESCRIPTION OF THE DRAWINGS

The accompanying drawings, which are included to provide a further understanding of the disclosure and are incorporated in and constitute a part of this application, illustrate embodiments of the disclosure and together with the description serve to explain principles of the disclosure. In the drawings.

DETAILED DESCRIPTION

Figure 1:
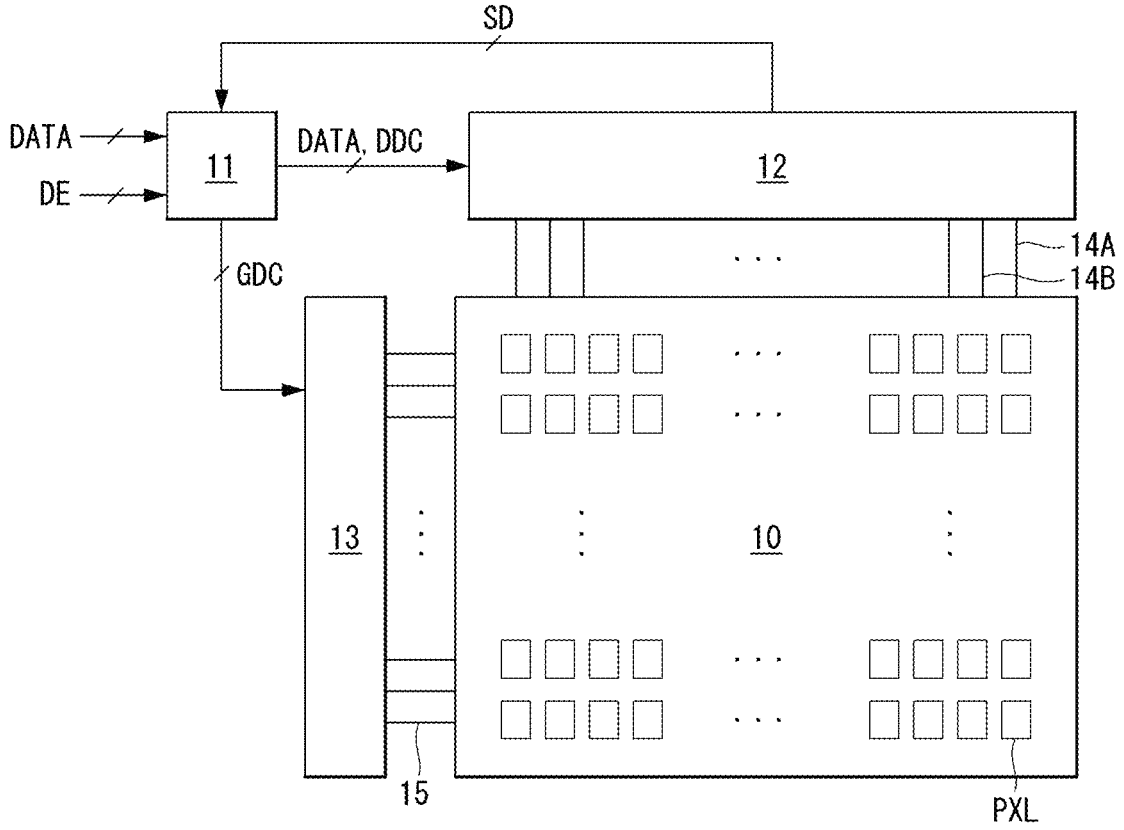
FIG. 1 is a schematic block diagram of a display device according to an exemplary embodiment of the present invention.

Advantages and features of the present disclosure and methods of accomplishing the same may be understood more readily by reference to the following detailed description of embodiments and the accompanying drawings. The present invention may, however, be embodied in many different forms and should not be construed as being limited to the embodiments set forth herein. Rather, these embodiments are provided so that this disclosure will be thorough and complete and will fully convey the concept of the invention to those skilled in the art, and the present invention will only be defined by the appended claims.

The shapes, sizes, proportions, angles, numbers, etc. shown in the figures to describe the exemplary embodiments of the present invention are merely examples and not limited to those shown in the figures. Like reference numerals denote like elements throughout the specification. When the terms 'comprise', 'have', 'consist of' and the like are used, other parts may be added as long as the term 'only' is not used. The singular forms may be interpreted as the plural forms unless explicitly stated.

The elements may be interpreted to include an error margin even if not explicitly stated.

When the position relation between two parts is described using the terms 'on', 'over', 'under', 'next to' and the like, one or more parts may be positioned between the two parts as long as the term 'immediately' or 'directly' is not used.

It will be understood that, although the terms first, second, etc., may be used to describe various elements, these elements should not be limited by these terms. These terms are only used to distinguish one element from another element. Thus, a first element discussed below could be termed a second element without departing from the technical idea of the present invention.

Like reference numerals denote like elements throughout the specification.

Hereinafter, an exemplary embodiment of the present invention will be described with reference to the accompanying drawings. In describing the present invention, detailed descriptions of related well-known technologies will be omitted to avoid unnecessary obscuring the present invention.

FIG. 1 is a schematic block diagram of a display device according to an exemplary embodiment of the present invention.

Referring to FIG. 1, a display device comprises a display panel 10 with a plurality of pixels, a scan driver 13, a data driver IC 12, a timing controller 11, etc.

A plurality of data lines 14A, a plurality of sensing lines 14B, and a plurality of scan lines 15 are arranged on the display panel 10. Pixels PXL are arranged at the intersections of the data lines 14A, sensing lines 14B, and scan lines 15. Each of the pixels PXL comprises an organic light-emitting diode (hereinafter, OLED) which emits light and a driving transistor (hereinafter, driving TFT) for driving the OLED.

The timing controller 16 is supplied with a data signal DATA in addition to a data enable signal DE or a driving signal including a vertical synchronization signal, a horizontal synchronization signal, and a clock signal. Based on the driving signal, the timing controller 11 outputs a gate timing control signal GDC for controlling the operation timing of the scan driver 13, and a data timing control signal DDC for controlling the operation timing of the data driver IC 12.

The scan driver 13 outputs a scan signal in response to the gate timing control signal GDC supplied from the timing controller 11. The scan driver 13 outputs a scan signal of scan-high voltage and scan-low voltage through the scan lines 15. The scan driver 13 may be formed in the form of an integrated circuit (IC) or in a gate-in-panel manner on the display panel 10.

The data driver IC 12 converts a digital data signal DATA to an analog data voltage based on gamma reference voltage, in response to the data timing control signal DDC supplied from the timing controller 11.

The elements included in the pixels PXL, like OLEDs or driving TFTs, may deteriorate over time, and their characteristics (e.g., threshold voltage) also may degrade over time. To compensate for this, the data driver IC 12 senses the characteristics of elements in at least one of the pixels PXL and sends sensing data SD as feedback to the timing controller 11. The timing controller 11 may correct the data signal DATA to be written to the pixel P based on the sensing data SD fed back from the data driver IC 12. A circuit for sensing the elements included in the pixel may be implemented as a separate sensing circuit from the data driver IC 12. However, the following description will be given of an example in which a sensing circuit is included inside the data driver IC 12.

Figure 2:
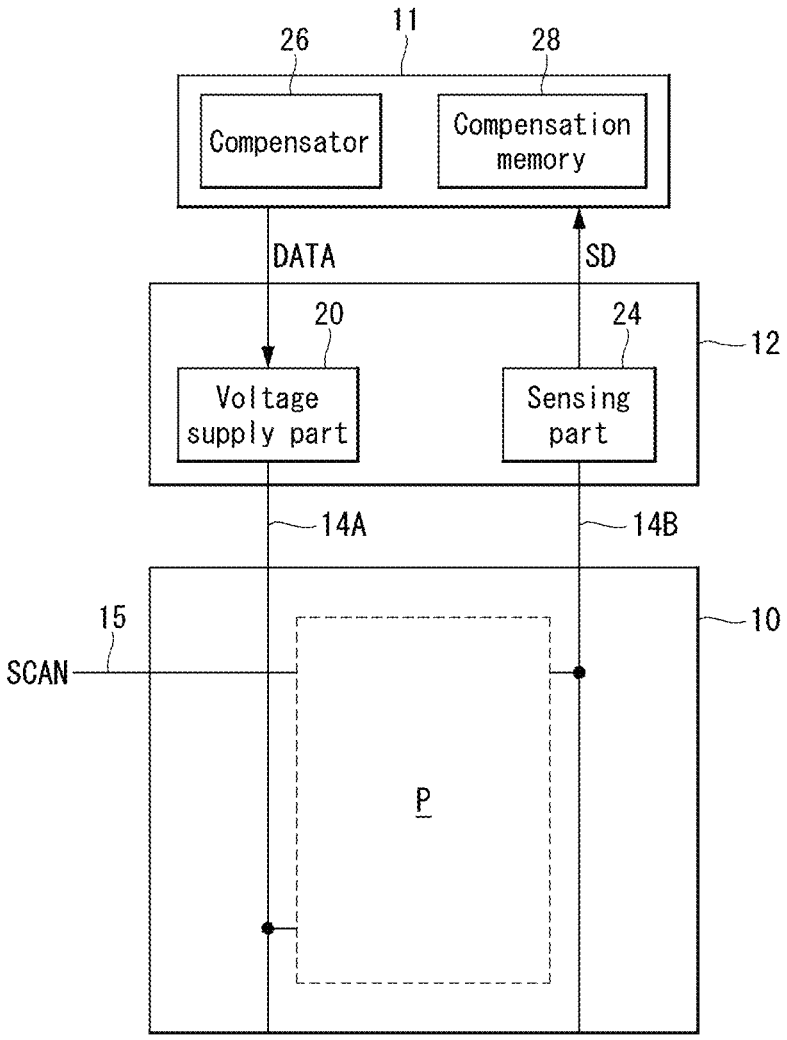
FIG. 2 is a view schematically showing a configuration of an external compensation circuit using the timing controller and data driver IC according to an exemplary embodiment of the present invention.

FIG. 2 is a view schematically showing a configuration of an external compensation circuit using the timing controller and data driver IC according to an exemplary embodiment of the present invention.

Referring to FIG. 2, the timing controller 11 comprises a compensation memory 28 storing sensing data SD for data compensation and a compensator 26 for compensating for a data signal DATA to be written to a pixel P.

The timing controller 11 may control the overall sensing operation in accordance with a predetermined sensing process. For example, a sensing operation may be performed when only the screen of the display device is off—for example, in a standby mode, sleep mode, low-power mode, etc.—while the system power is being applied, but the sensing operation is not limited thereto.

The compensator 26 corrects the data signal DATA to be written to the pixel P and outputs it to the data driver IC 12, based on the sensing data SD stored in the compensation memory 28.

The data driver IC 12 comprises a voltage supply part 20 for outputting a data voltage to be written to the pixel P and a sensing part 24 for sensing the characteristics of the elements included in the pixel P.

The voltage supply part 20 may output a data voltage for display or a data voltage for sensing through a data channel connected to a data line 14A. The voltage supply part 20 may have a plurality of data channels. The voltage supply part 20 comprises a digital-to-analog converter (DAC) for converting a digital signal to an analog signal, and generates a data voltage for display or a data voltage for sensing.

In a display operation, the voltage supply part 20 generates a data voltage for display in response to a data timing control signal DDC provided by the timing controller 11. The voltage supply part 20 supplies the data voltage for display to a data line 14A. In the display operation, the data voltage for display supplied to the data line 14A is applied to the pixel P in synchronization with the turn-on timing of a scan signal SCAN for display.

In a sensing operation, the voltage supply part 20 generates a preset data voltage for sensing. The voltage supply part 20 supplies it to the data line 14A. In the sensing operation, the data voltage for sensing supplied to the data lines 14A is applied to the pixel P in synchronization with the turn-on timing of a scan signal SCAN for sensing. The gate-source voltage of the driving TFT included in the pixel P is programmed by the data voltage for sensing, and the drive current flowing through the driving TFT is determined by the gate-source voltage of the driving TFT.

The sensing part 24 may sense the display panel 10 through a sensing channel connected to a sensing line 14B. The sensing part 24 may have a plurality of sensing channels. The sensing part 24 senses the characteristics of elements included in the pixel P through the sensing line 14B. The sensing part 24 may sense a sensing node that is defined between a drain electrode of the driving TFT in the pixel P and an anode of the OLED in it. The sensing part 24 performs sensing operation under control of the timing controller 11. The sensing part 24 senses and samples a signal from the pixel P, and converts the sampled signal to an analog-to-digital converter (hereinafter, ADC) and outputs it to the timing controller 11.

A sensing operation may be performed during a vertical blanking interval in a display operation, during a power-on sequence before the start of the display operation or during a power-off sequence after the end of the display operation. However, the sensing operation is not limited to this, but may be performed during a vertical active period in the display operation. The vertical blanking interval is the time during which no input video data is written, between each vertical active period during which 1 frame of input video data is written. The power-on sequence is a transition period from turning on the driving power until displaying an input image. The power-off sequence is a transition period from the end of display of an input image until turning off the driving power.

Figure 3:
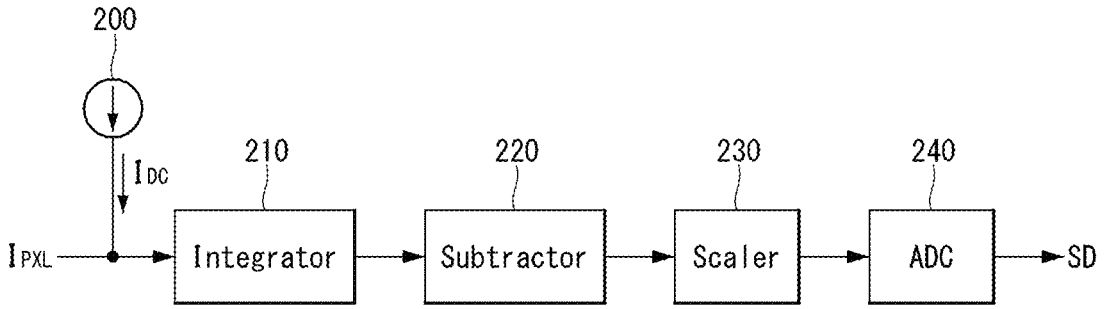
FIG. 3 is a view schematically showing a configuration of the sensing part according to a first exemplary embodiment of the present invention.
Figure 4:
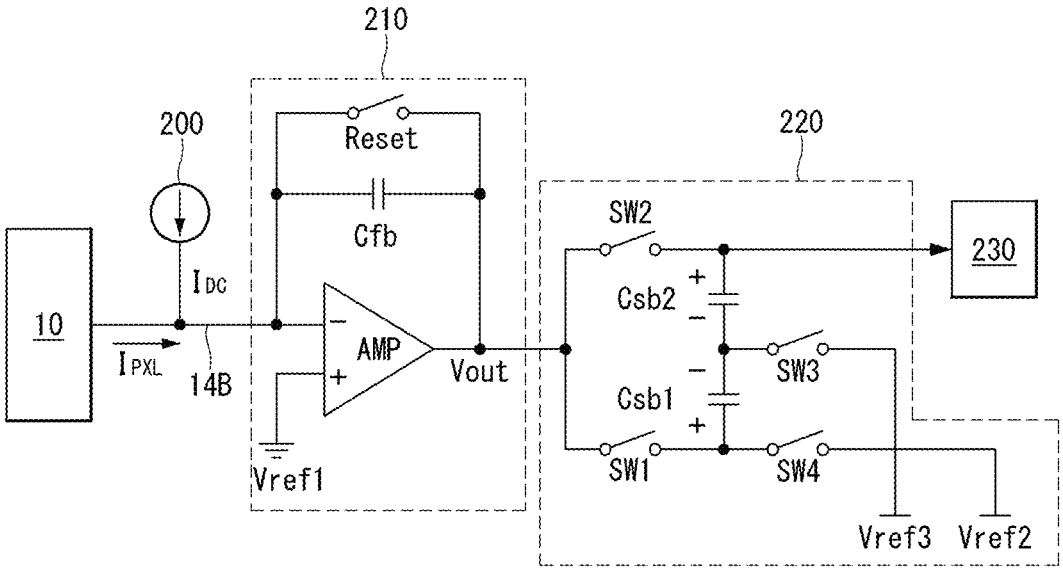
FIG. 4 is a view showing in detail the configuration of the sensing part according to the first exemplary embodiment of the present invention.

FIG. 3 is a view schematically showing a configuration of the sensing part according to a first exemplary embodiment of the present invention. FIG. 4 is a view showing in detail the configuration of the sensing part according to the first exemplary embodiment of the present invention.

Referring to FIG. 3, the sensing part comprises a current source 200, an integrator 210, a subtractor 220, a scaler 230, and an analog-to-digital converter 240.

The current source 200 applies a direct current IDC to an input terminal of the integrator 210.

The integrator 210 integrates a sensing current IPXL obtained through sensing and the direct current IDC applied from the current source 200 and outputs an integrated value. The subtractor 220 performs an operation of subtracting part of the voltage (charge) stored in it, in order to take a second output from the integrated value outputted from the integrator 210, but not a first output. Through the subtraction operation, the subtractor 220 may take only the sensing current IPXL, but not the direct current IDC, from the sum of the direct current IDC and sensing current IPXL calculated by the integrator 210.

The scaler 230 performs scaling to increase the rate of recognition of the sensing current IPXL outputted through the subtractor 220. The scaler 230 may perform upscaling or downscaling depending on the state of the sensing current IPXL outputted through the subtractor 220. The analog-to-digital converter 240 converts the sensing current IPXL outputted through the scaler 230 to digital sensing data SD and outputs it.

Referring to FIG. 4, a configuration of the current source 200, integrator 210, and subtractor 220 according to the first exemplary embodiment will be illustrated in detail.

The current source 200 is connected to an inverting input terminal (−) of an amplifier AMP included in the integrator 210. The inverting input terminal (−) of the AMP may be defined as a sensing channel. The current source 200 applies a direct current IDC to the inverting input terminal (−) of the amplifier AMP. The direct current IDC is preset to a higher current value than the sensing current IPXL obtained through sensing from a pixel on the display panel 10. The current source 200 may output a stationary direct current IDC, or may output a varied direct current IDC which is controlled by a device internal or external to the data driver IC. The current source 200 may be included in an external device, rather than in an internal device.

The integrator 210 comprises an AMP, an integrating capacitor Cfb, and a reset switch Reset. The amplifier AMP obtains the sensing current IPXL from the pixel on the display panel 10 through the inverting input terminal (−). The inverting input terminal (−) of the amplifier AMP is connected to the sensing line 14B on the display panel 10, and a non-inverting terminal (+) of the amplifier AMP is connected to a first reference voltage source Vref1. The integrating capacitor Cfb and the reset switch Reset are connected in parallel between the inverting input terminal (−) and output terminal Vout of the amplifier AMP.

The subtractor 220 comprises a first switch group SW1 and SW2 comprising at least two switches, a capacitor group Csb1 and Csb2 comprising at least two capacitors, a second switch group SW3 and SW4 comprising at least two switches, a second reference voltage source Vref2, and a third reference voltage source Vref3. The first switch group SW1 and SW2 and the second switch group SW3 and SW4 are turned on or off, controlled by a device internal or external to the data driver IC. The third reference voltage source Vref3 may be defined as a first reference voltage source of the subtractor 220, and the second reference voltage source Vref2 may be defined as a second reference voltage source of the subtractor 220.

The first switch group SW1 and SW2 may comprise a first switch SW1 and a second switch SW2, the capacitor group Csb1 and Csb2 may comprise a first capacitor Csb1 and a second capacitor Csb2, and the second switch group SW3 and SW4 may comprise a third switch SW3 and a fourth switch SW4. The connections between the above-defined circuit components in the subtractor 220 will be described below.

One end of the first switch SW1 is connected to the output terminal Vout of the amplifier AMP, and the other end is connected to a first electrode (+) of the first capacitor Csb1. One end of the second switch SW2 is connected to the output terminal Vout of the amplifier AMP, and the other end is connected to a first electrode (+) of the second capacitor Csb2 and an input terminal of the scaler 230.

The first electrode (+) of the first capacitor Csb1 is connected to the other end of the first switch SW1 and one end of the fourth switch SW4, and a second electrode (−) thereof is connected to a second electrode (−) of the second capacitor Csb2 and one end of the third switch SW3. The first electrode (+) of the second capacitor Csb2 is connected to the other end of the second switch SW2 and the input terminal of the scaler 230, and the second electrode (−) thereof is connected to the second electrode (−) of the first capacitor Csb1 and the one end of the third switch SW3.

The one end of the third switch SW3 is connected to the second electrodes (−) of the first capacitor Csb1 and second capacitor Csb2, and the other end thereof is connected to the third reference voltage source Vref3. One end of the fourth switch SW4 is connected to the first electrode (+) of the first capacitor Csb1, and the other end is connected to the second reference voltage source Vref2.

One or more of first to third voltages outputted from the first reference voltage source Vref1 in the integrator 210 and the second and third reference voltage sources Vref2 and Vref3 in the subtractor 220 have a different level. The second and third voltages respectively outputted from the second and third reference voltage sources Vref2 and Vref3 are set to different levels in order to establish a criterion for excluding the direct current IDC applied to an input terminal during a subtraction operation of the subtractor 220.

Because the amplifier AMP included in the integrator 210 tend to keep the voltages of the inverting input terminal (−) and non-inverting input terminal (+) constant, the output voltage from the output terminal Vout of the amplifier AMP is adjusted by the amount of charge in the integrating capacitor Cfb. The sensing current IPXL obtained from the pixel on the display panel 10 flows through the integrating capacitor Cfb of the integrator 210. By the sensing current IPXL, an electric charge is stored in the integrating capacitor Cfb. Based on this process, the integrator 210 integrates the current flowing through the integrating capacitor Cfb each time a sensing operation is performed, and outputs a voltage corresponding to the integrated value through the output terminal Vout.

However, if the current that can be obtained from a sensing node in the pixel is lower than several tens of nA (e.g., 10 nA), it is difficult to perform sensing by the integrator 210 alone. For example, it is not possible to sense a low current by the integrator 210 alone. This is because the smaller the size of the driving TFT, the smaller the amount of current, e.g., sensing current IPXL, flowing through the driving TFT. This will be described in further details below.

There are differences in electron mobility between the driving TFTs, which is based on oxide, and the TFTs present in the data driver IC, which are based on crystal silicon. Due to this, the sensing part may recognize a small amount of current flowing through the driving TFT as a sort of leakage current and therefore cannot sense it.

Moreover, the sensing voltage range of the analog-to-digital converter 240 is set in accordance with the input voltage range. Although it depends on its conversion resolution, the analog-to-digital converter 240 may produce an output that is outside the input voltage range, causing an overflow, in which the output is lower than the lower limit of the input voltage, or an underflow, in which the output is higher than the upper limit of the input voltage. Therefore, if a sensing value is recognized as a leakage current, this will produce an inaccurate sensing result and make it difficult to precisely compensate for it.

To solve this problem, in the first exemplary embodiment, a direct current IDC that has a higher current value (large current) than the sensing current IPXL obtained through sensing is applied to the inverting input terminal (−) of the integrator 210 by using the current source 200. Then, only the sensing current IPXL, but not the direct current IDC outputted from the integrator 210, is separated, taken, and outputted by using the subtractor 220.

Figure 5:
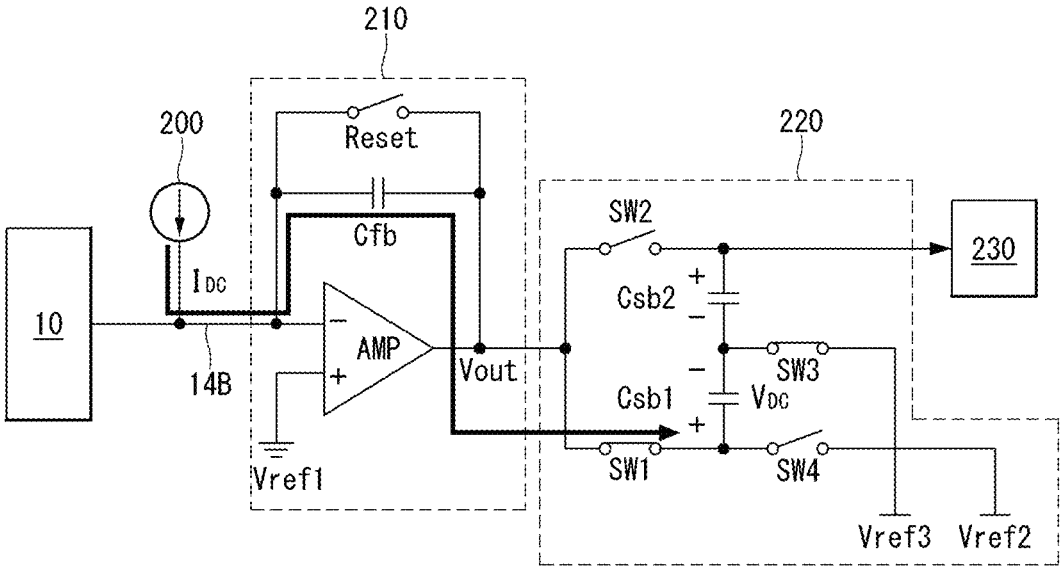
FIGS. 5 and 6 are views showing a first operation process of the sensing part and the voltage stored in the first capacitor by the first operation according to the first exemplary embodiment of the present invention.
Figure 6:
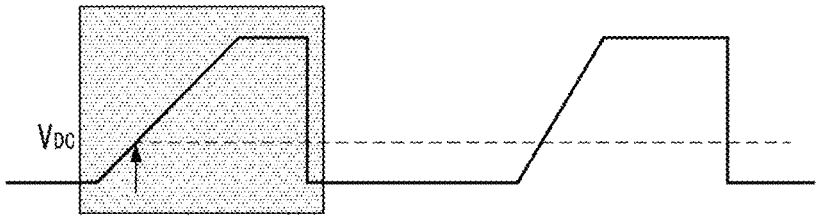
Figure 7:
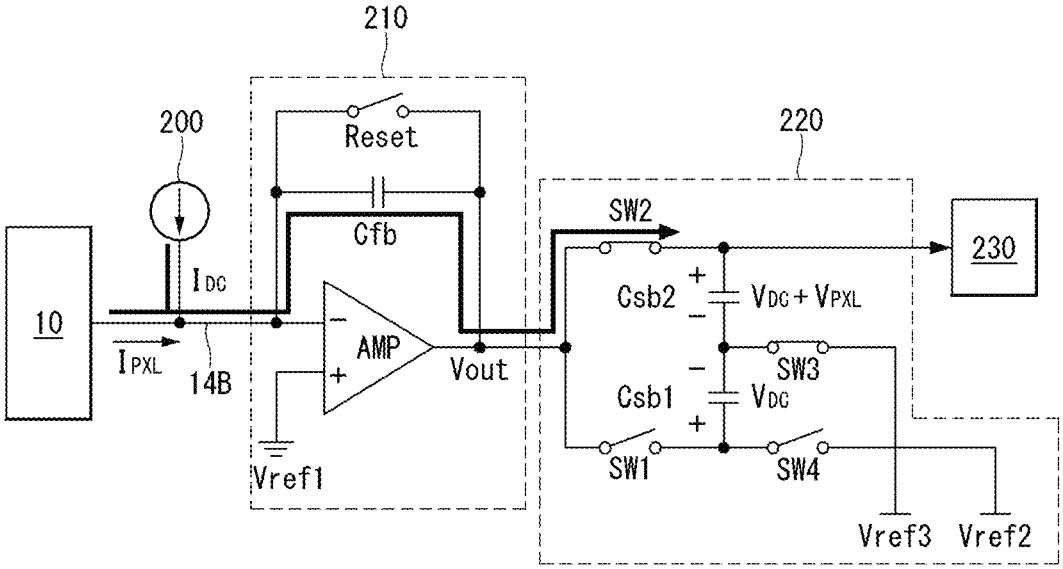
FIGS. 7 and 8 are views showing a second operation process of the sensing part and the voltages stored in the first and second capacitors by the second operation according to the first exemplary embodiment of the present invention.
Figure 8:
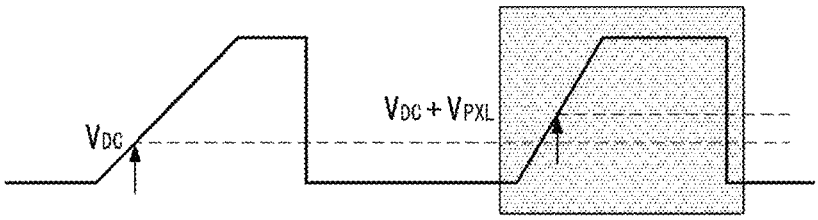
Figure 9:
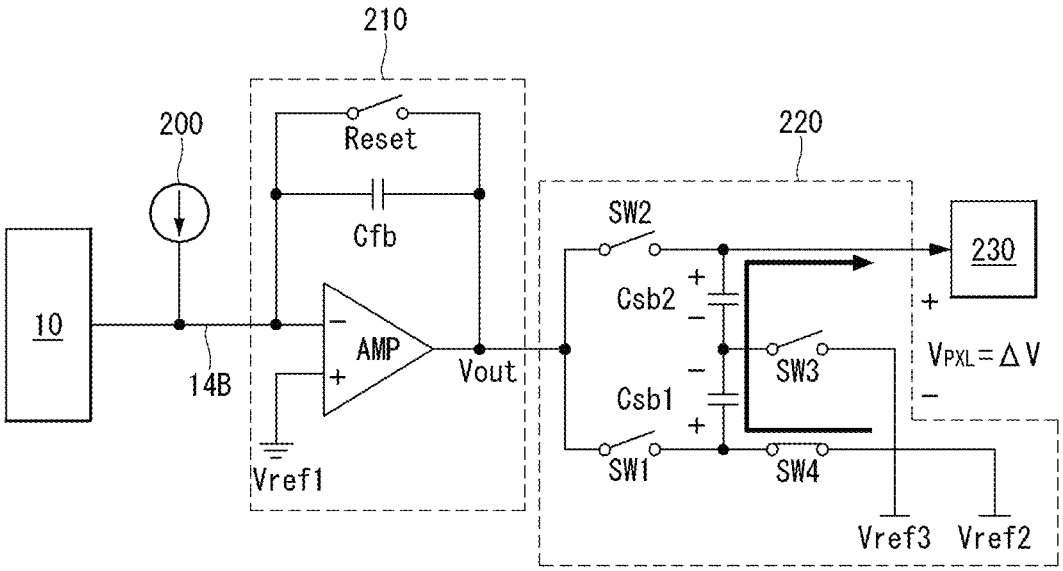
FIGS. 9 and 10 are views showing a third operation process of the sensing part and the voltage taken from the first and second capacitors by the third operation according to the first exemplary embodiment of the present invention.
Figure 10:
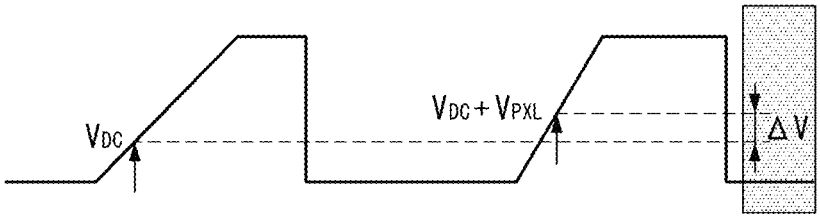

FIGS. 5 and 6 are views showing a first operation process of the sensing part and the voltage stored in the first capacitor by the first operation according to the first exemplary embodiment of the present invention. FIGS. 7 and 8 are views showing a second operation process of the sensing part and the voltages stored in the first and second capacitors by the second operation according to the first exemplary embodiment of the present invention. FIGS. 9 and 10 are views showing a third operation process of the sensing part and the voltage taken from the first and second capacitors by the third operation according to the first exemplary embodiment of the present invention.

As shown in FIGS. 5 and 6, when the current source 200 is driven to apply a direct current IDC to the inverting input terminal (−) of the amplifier AMP before measuring a sensing current IPXL, the direct current IDC applied to the inverting input terminal (−) of the amplifier AMP is integrated at the integrating capacitor Cfb and then outputted through the output terminal Vout of the amplifier AMP.

In the first operation process (first operation time), when an output is produced from the integrator 210, the first switch SW1 and third switch SW3 of the subtractor 220 are turned on. As the first switch SW1 and the third switch SW3 are turned on, the first capacitor Csb1 is charged with a direct current voltage VDC corresponding to the direct current IDC applied to the inverting input terminal (−) of the amplifier AMP. In the first operation process, the second switch SW2 and the fourth switch SW4 are in the off state.

In the first operation process explained with reference to FIGS. 5 and 6, the direct current IDC higher than the sensing current obtained through sensing is applied to the inverting input terminal (−) of the integrator 210 to charge the first capacitor Csb1 with the direct current voltage VDC which is used later as a reference for taking a sensing value.

As shown in FIGS. 7 and 8, when a data voltage for sensing, along with the application of the direct current IDC, is applied to a pixel included in the display panel 10 and a sensing operation is performed on the pixel, the direct current IDC and the sensing current IPXL are applied to the inverting input terminal (−) of the amplifier AMP. The direct current IDC and sensing current IPXL applied to the inverting input terminal (−) of the amplifier AMP are integrated at the integrating capacitor Cfb and then outputted through the output terminal Vout of the amplifier AMP.

In the second operation process (second operation time), when an output is produced from the integrator 210, the second switch SW2 and third switch SW3 of the subtractor 220 are turned on. As the second switch SW2 and the third switch SW3 are turned on, the second capacitor Csb2 is charged with a direct current voltage and sensing voltage VDC+VPXL corresponding to the direct current IDC and sensing current IPXL applied to the inverting input terminal (−) of the amplifier AMP.

In a transition from the first operation process to the second operation process, the first switch SW1 switches to the off state, and the second switch SW2 is turned on. The third switch SW3 stays turned on during the second operation process as well as during the first operation process. In contrast, the fourth switch SW4 stays turned off during the second operation process as well as during the first operation process.

In the second operation process explained with reference to FIGS. 7 and 8, the direct current IDC is artificially applied to the inverting input terminal (−) of the integrator 210 to charge the second capacitor Csb2 with the direct current voltage and sensing voltage VDC+VPXL, in order to enhance the capability of sensing the sensing current IPXL which is a low current.

As shown in FIGS. 9 and 10, after measuring the direct current voltage and sensing voltage VDC_VPXL, a subtraction operation is performed on the voltages charged in the first capacitor Csb1 and second capacitor Csb2. Then, the difference ΔV taken from the first capacitor Csb1 and second capacitor Csb2 is outputted through the subtractor 220 and then delivered to the input terminal of the scaler 230.

In the third operation process (third operation time), the first to third switches SW1 to SW3 of the subtractor 220 are all turned off, and the fourth switch SW4 is turned on. Voltage offsetting does not occur between the first capacitor Csb1 and the second capacitor Csb2, although their cathodes are connected to each other, because they are electrically floating (due to the turn-off of SW1 to SW3).

However, in the third operation process, voltage offsetting occurs between the first capacitor Csb1 and the second capacitor Csb2 as the fourth switch SW4 connected to the second reference voltage source Vref2 is turned on. As a consequence, the voltage VDC+VPXL maintained in the second capacitor Csb2 is offset by the voltage VDC maintained in the first capacitor Csb1, and only the difference ΔV between the two voltages is taken.

Assuming that the first capacitor Csb1 is charged with a voltage of 8 V in the first operation process and the second capacitor Csb2 is charged with a voltage of 9 V in the second operation process, the difference ΔV of 1 V may be outputted by the voltage offsetting in the third operation process.

In the third operation process explained with reference to FIGS. 9 and 10, voltage offsetting occurs between the first capacitor Csb1 and the second capacitor Csb2 so that only the difference ΔV is taken.

The difference ΔV delivered to the input terminal of the scaler 230, in turn, corresponds to the sensing voltage VPXL corresponding to the sensing current IPXL. Accordingly, in the first exemplary embodiment, the sensing capability can be enhanced enough to allow for relatively precise sensing even if the amount of sensing current decreases as the driving TFT gets smaller in size.

Figure 11:
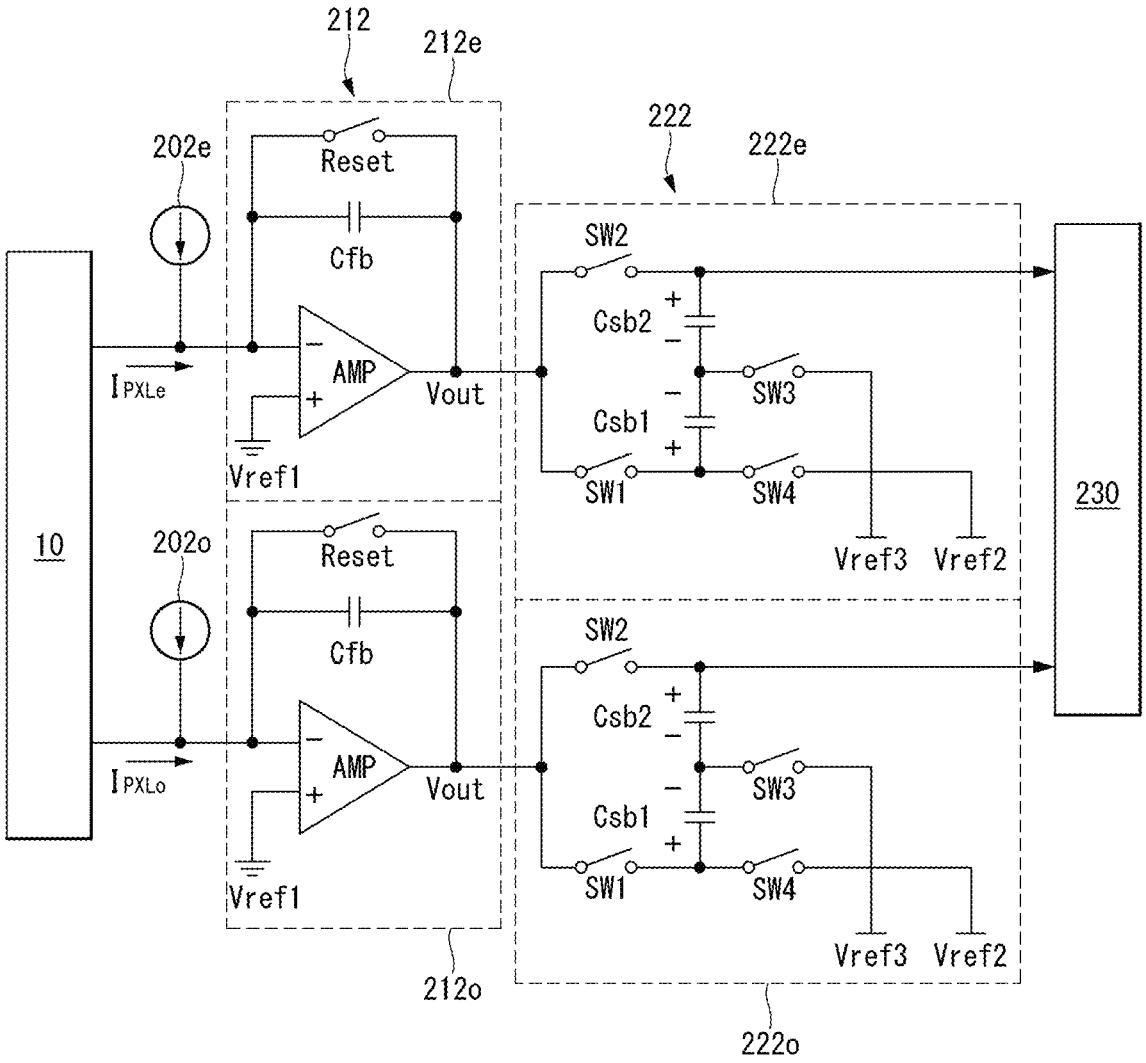
FIG. 11 is a view showing in detail a configuration of the sensing part according to a second exemplary embodiment of the present invention.

FIG. 11 is a view showing in detail a configuration of the sensing part according to a second exemplary embodiment of the present invention.

Referring to FIG. 11, configurations of an integrator 212 and subtractor 222 according to the second exemplary embodiment of the present invention are illustrated in detail. A configuration and operation of first and second current sources 2020 and 202*e* are identical to those in the first exemplary embodiment, so descriptions thereof will be given with reference to FIG. 4, etc.

The integrator 212 comprises a first integrator 2120 and a second integrator 212*e*. The first integrator 2120 and the second integrator 212*e* each comprise an amplifier AMP, an integrating capacitor Cfb, and a reset switch Reset. The amplifier AMP of the first integrator 2120 may take a first sensing current IPXLo from a first pixel through an inverting input terminal (−) connected to a first sensing line 14Bo on the display panel 10. The amplifier AMP of the second integrator 212*e* may take a second sensing current IPXLe from a second pixel on the display panel 10 through an inverting input terminal (−) connected to a second sensing line 14Be on the display panel 10.

The first integrator 2120 and the second integrator 212*e* are implemented in the same manner, except that an input terminal of the first integrator 2120 is connected to the first sensing line 14Bo and an input terminal of the second integrator 212*e* is connected to the second sensing line 14Be. Therefore, only circuit connections in the first integrator 2120 will be described, and a description of circuit connections in the second integrator 212*e* will be substituted with the following description.

The inverting input terminal (−) of the amplifier AMP included in the first integrator 2120 is connected to the first sensing line 14Bo on the display panel 10, and a non-inverting input terminal (+) of the amplifier AMP is connected to a first reference voltage source Vref1. The integrating capacitor Cfb and the reset switch Reset are connected in parallel between the inverting input terminal (−) and output terminal Vout of the amplifier AMP.

The subtractor 222 comprises a first subtractor 222*o* and a second subtractor 222*e*. The first subtractor 222*o* and the second subtractor 222*e* each comprise a first switch group SW1 and SW2 comprising at least two switches, a capacitor group Csb1 and Csb2 comprising at least two capacitors, a second switch group SW3 and SW4 comprising at least two switches, a second reference voltage source Vref2, and a third reference voltage source Vref3.

The first subtractor 222*o* and the second subtractor 222*e* are implemented in the same manner, except that an output terminal of the first subtractor 222*o* is connected to a first input terminal of the scaler 230 and an output terminal of the second subtractor 222*e* is connected to a second input terminal of the scaler 230. Therefore, only circuit connections in the first subtractor 222*o* will be described, and a description of circuit connections in the second subtractor 222*e* will be substituted with the following description.

One end of the first switch SW1 included in the first subtractor 222*o* is connected to the output terminal Vout of the amplifier AMP, and the other end is connected to a first electrode (+) of the first capacitor Csb1. One end of the second switch SW2 is connected to the output terminal Vout of the amplifier AMP, and the other end is connected to a first electrode (+) of the second capacitor Csb2 and the first input terminal of the scaler 230.

The first electrode (+) of the first capacitor Csb1 is connected to the other end of the first switch SW1 and one end of the fourth switch SW4, and a second electrode (−) thereof is connected to a second electrode (−) of the second capacitor Csb2 and one end of the third switch SW3. The first electrode (+) of the second capacitor Csb2 is connected to the other end of the second switch SW2 and the first input terminal of the scaler 230, and the second electrode (−) thereof is connected to the second electrode (−) of the first capacitor Csb1 and the one end of the third switch SW3.

The one end of the third switch SW3 is connected to the second electrodes (−) of the first capacitor Csb1 and second capacitor Csb2, and the other end thereof is connected to the third reference voltage source Vref3. One end of the fourth switch SW4 is connected to the first electrode (+) of the first capacitor Csb1, and the other end is connected to the second reference voltage source Vref2.

One or more of first to third voltages outputted from the first reference voltage source Vref1 in the first integrator 2120 and the second and third reference voltage sources Vref2 and Vref3 in the first subtractor 222*o* have a different level. The second and third voltages respectively outputted from the second and third reference voltage sources Vref2 and Vref3 are set to different levels in order to establish a criterion for excluding the direct current IDCo applied to an input terminal during a subtraction operation of the first subtractor 222*o*.

The inverting input terminal (−) of the amplifier AMP included in the first integrator 2120 may be defined as a first sensing channel, and the inverting input terminal (−) of the amplifier AMP included in the second integrator 212*e* may be defined as a second channel. The first integrator 2120 and the second integrator 212*e* may obtain the first sensing current IPXLo and the second sensing current IPXLe, respectively, through two channels.

In the second exemplary embodiment, though similar to the first exemplary embodiment, can eliminate or improve the effects of noise components that may be introduced during a sensing operation, as well as enhancing the capability of sensing a sensing current IPXL which is a low current, by using at least two integrators 2120 and 212*e* and at least two subtractors 2220 and 222*e*. To this end, only one of the first and second integrators 2120 and 212*e* obtains a sensing current through a sensing line on the display panel, and the other one obtains noise components or the like through a sensing line on the display panel. Therefore, a noise reducing operation will be described below with an example in which only the first integrator 2120 having a first channel senses a first pixel on the display panel 10.

Figure 12:
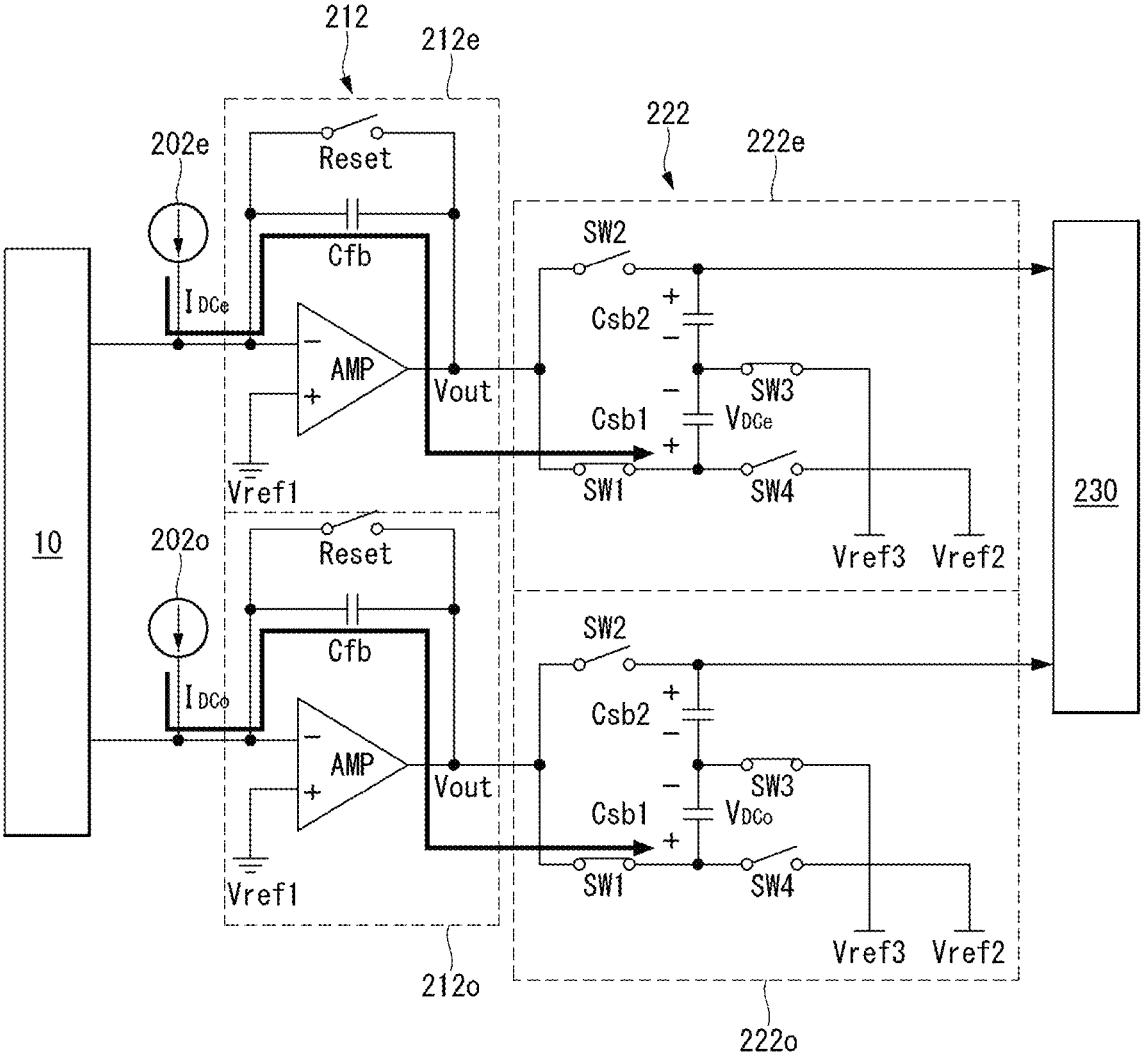
FIGS. 12 and 13 are views showing a first operation process of the sensing part and the voltage stored in the first capacitor by the first operation according to the second exemplary embodiment of the present invention.
Figure 13:
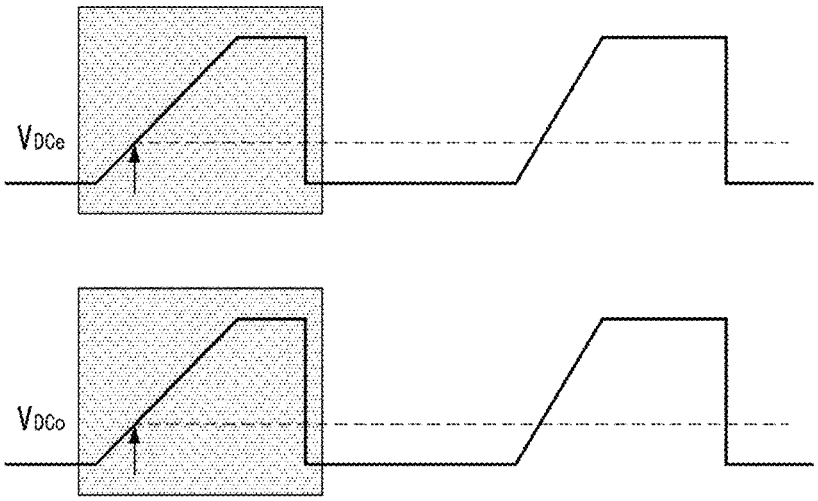
Figure 14:
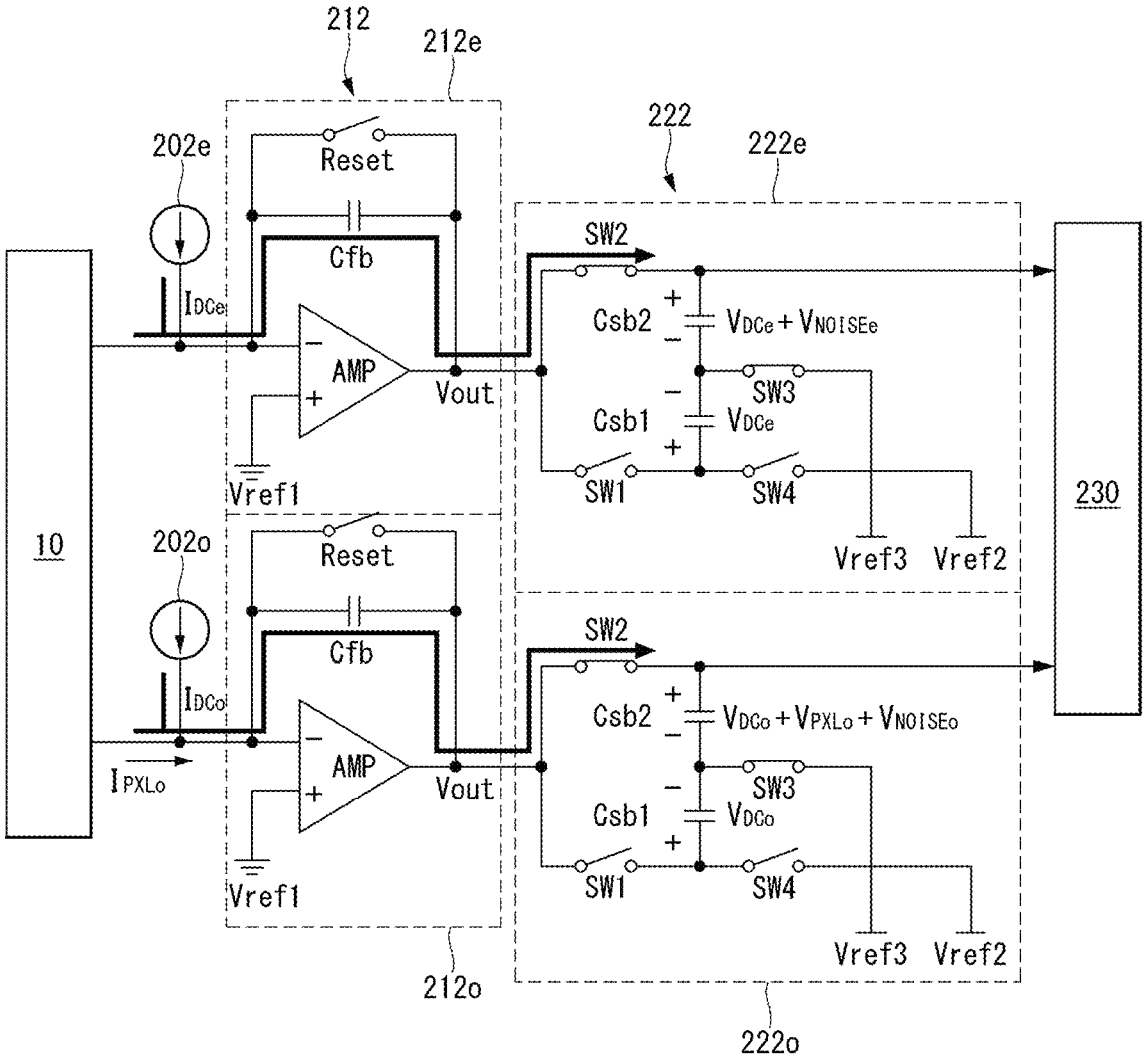
FIGS. 14 and 15 are views showing a second operation process of the sensing part and the voltages stored in the first and second capacitors by the second operation according to the second exemplary embodiment of the present invention.
Figure 15:
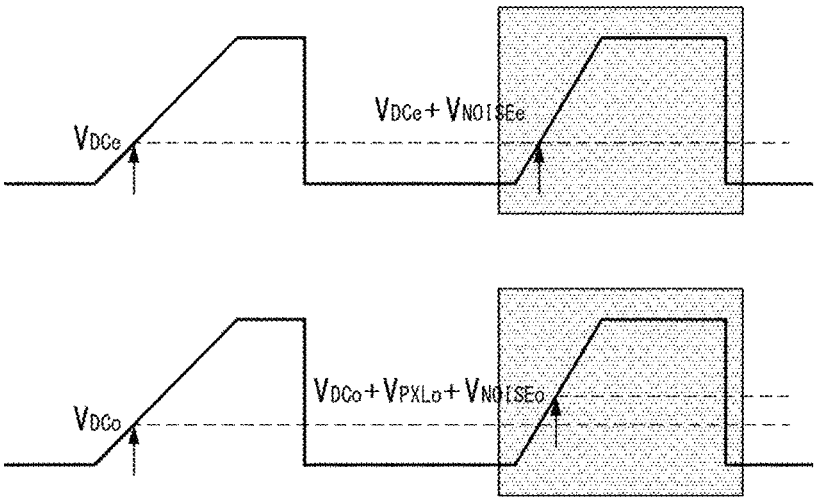
Figure 16:
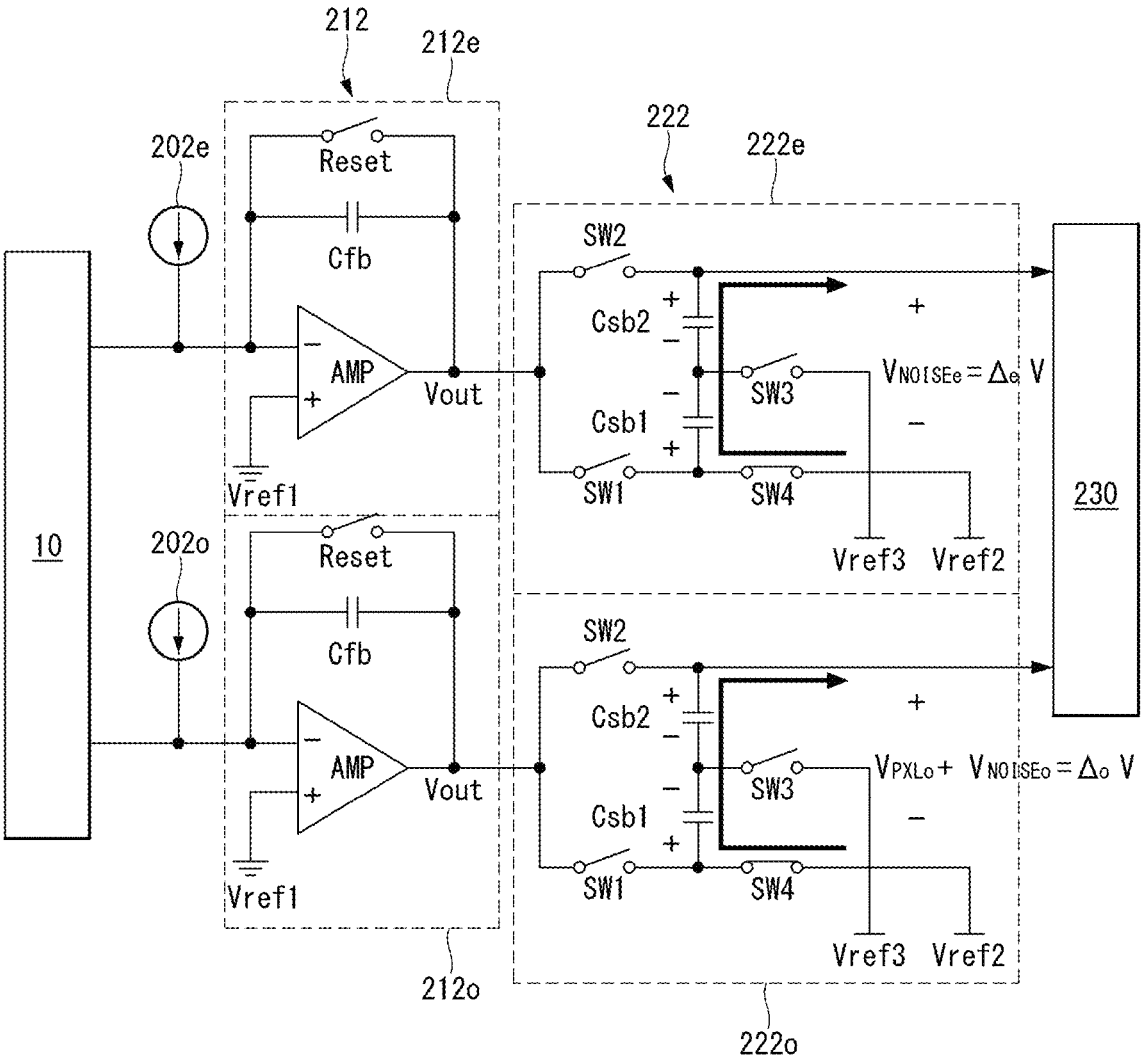
FIGS. 16 and 17 are views showing a third operation process of the sensing part and the voltage taken from the first and second capacitors by the second operation according to the second exemplary embodiment of the present invention.
Figure 17:
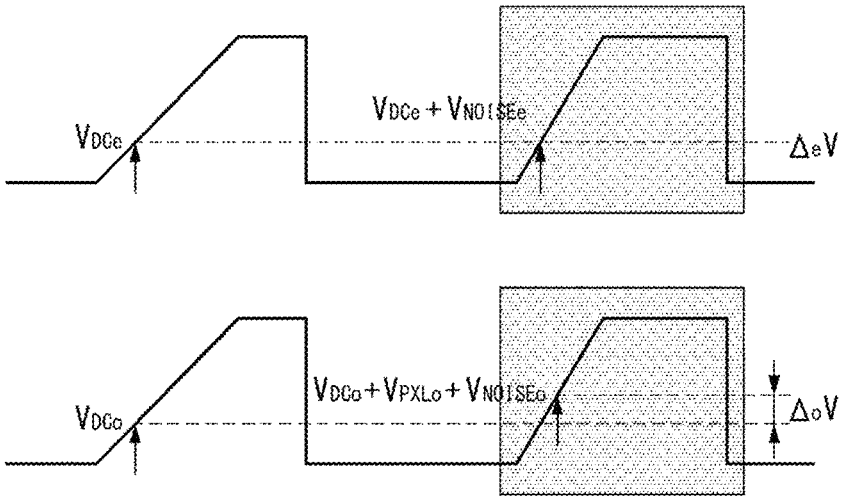

FIGS. 12 and 13 are views showing a first operation process of the sensing part and the voltage stored in the first capacitor by the first operation according to the second exemplary embodiment of the present invention. FIGS. 14 and 15 are views showing a second operation process of the sensing part and the voltages stored in the first and second capacitors by the second operation according to the second exemplary embodiment of the present invention. FIGS. 16 and 17 are views showing a third operation process of the sensing part and the voltage taken from the first and second capacitors by the second operation according to the second exemplary embodiment of the present invention.

As shown in FIGS. 12 and 13, when the first and second current sources 2020 and 202*e* are driven before measuring a sensing current IPXL, the first and second direct currents IDCo and IDCe respectively applied to the inverting input terminals (−) of the amplifiers AMP included in the first and second integrators 2120 and 212*e* are respectively integrated at the integrating capacitors Cfb and then outputted through the output terminals Vout of the amplifiers AMP.

In the first operation process (first operation time), when outputs are produced from the first integrator 2120 and second integrator 212*e*, the first switches SW1 and third switches SW3 of the first subtractor 222*o* and second subtractor 222*e* are turned on. As the first switches SW1 and the third switches SW3 of the first subtractor 222*o* and second subtractor 222*e* are turned on, the first capacitors Csb1 of the first subtractor 222*o* and second subtractor 222*e* are respectively charged with direct current voltages VDCo and VDCe corresponding to the direct currents IDCo and IDCe applied to the inverting input terminals (−) of the amplifiers AMP. In the first operation process, the second switches SW2 and fourth switches SW4 of the first subtractor 222*o* and second subtractor 222*e* are in the off state.

In the first operation process explained with reference to FIGS. 12 and 13, the first and second direct currents IDCo and IDCe higher than the sensing currents obtained through sensing are applied to the inverting input terminals (−) of the first integrator 2120 and second integrator 212*e* to charge the first capacitors Csb1 of the first subtractor 222*o* and second subtractor 222*e* with the direct current voltages VDCo and VDCe which are used later as a reference for taking sensing values.

As shown in FIGS. 14 and 15, a data voltage for sensing, along with the application of the first and second direct currents IDCo and IDCe, is applied to the first pixel included in the display panel 10 to perform a sensing operation on the first pixel but not on the second pixel. Then, the first direct current IDCo, the first sensing current IPXLo, and a first noise component are applied to the inverting input terminal (−) of the amplifier AMP included in the first integrator 2120. The noise refers to parasitic elements or the like that are created due to leakage current present in the display panel 10 or second sensing line 14B or due to coupling with other lines. The first direct current IDCo, first sensing current IPXLo, and first noise component applied to the inverting input terminal (−) of the amplifier AMP included in the first integrator 2120 are integrated at the integrating capacitor Cfb and then outputted through the output terminal Vout of the amplifier AMP.

In contrast to this, only the second direct current IDCe and a second noise component are applied to the inverting input terminal (−) of the amplifier AMP included in the second integrator 212*e*. This is because no sensing operation is performed on the second pixel. The second direct current IDCe and second noise component applied to the inverting input terminal (−) of the amplifier AMP included in the second integrator 212*e* are integrated at the integrating capacitor Cfb and then outputted through the output terminal Vout of the amplifier AMP.

In the second operation process (second operation time), when an output is produced from the first integrator 2120, the second switch SW2 and third switch SW3 of the first subtractor 222*o* are turned on. As the second switch SW2 and the third switch SW3 are turned on, the second capacitor Csb2 is charged with a first direct current voltage, first sensing voltage, and first noise voltage VDCo+VPXLo+

VNOISEo corresponding to the first direct current IDCo, first sensing current IPXLo, and first noise component applied to the inverting input terminal (−) of the amplifier AMP.

At the same time, when an output is produced from the second integrator 212*e*, the second switch SW2 and third switch SW3 of the second subtractor 222*e* are turned on. As the second switch SW2 and the third switch SW3 are turned on, the second capacitor Csb2 is charged with a second direct current VDCe+VNOISEe corresponding to the second direct current IDCe and second noise component applied to the inverting input terminal (−) of the amplifier AMP.

In a transition from the first operation process to the second operation process, the first switches SW1 of the first subtractor 222*o* and second subtractor 222*e* switch to the off state, and their second switches SW2 are turned on. The third switches SW3 of the first subtractor 222*o* and second subtractor 222*e* stay turned on during the second operation process as well as during the first operation process. In contrast, the fourth switches SW4 of the first subtractor 222*o* and second subtract 222*e* stay turned off during the second operation process as well as during the first operation process.

In the second operation process explained with reference to FIGS. 14 and 15, the first direct current IDCo is artificially applied to the inverting input terminal (−) of the first integrator 2120 to charge the second capacitor Csb2 with the first direct current voltage, first sensing voltage, and first noise voltage VDCo+VPXLo+VNOISEo, while measuring the first sensing current IPXLo in order to enhance the capability of sensing the sensing current IPXL which is a low current. Also, the second direct current IDCe is artificially applied to the inverting input terminal (−) of the second integrator 212*e* to charge the second capacitor Csb2 with the second direct current voltage and second noise voltage VDCe+VNOISEe.

As shown in FIGS. 16 and 17, after measuring different values in the first subtractor 222*o* and second subtractor 222*e*, a subtraction operation is performed on the voltages charged in the first capacitors Csb1 and second capacitors Csb2 of the first subtractor 222*o* and second subtractor 222*e*. Then, the values taken from the first capacitors Csb1 and second capacitors Csb2 of the first subtractor 222*o* and second subtractor 222*e* are respectively outputted through the first subtractor 222*o* and second subtractor 222*e* and then delivered to the first and second input terminals of the scaler 230.

In the third operation process (third operation time), the first to third switches SW1 to SW3 of the first subtractor 222*o* and second subtractor 222*e* are all turned off, and the fourth switches SW4 are turned on. Voltage offsetting does not occur between the first capacitor Csb1 and second capacitor Csb2 of each of the first subtractor 222*o* and second subtractor 222*e*, although their cathodes are connected to each other, because they are electrically floating (due to the turn-off of SW1 to SW3).

However, in the third operation process, voltage offsetting occurs between the first capacitor Csb1 and second capacitor Csb2 of each of the first subtractor 2220 and second subtractor 222*e* as the fourth switch SW4 connected to the second reference voltage source Vref2 is turned on. As a consequence, the voltage VDCo+VPXLo+VNOISEo maintained in the second capacitor Csb2 of the first subtractor 222*o* is offset by the voltage VDCo maintained in the first capacitor Csb1, leaving only the difference VPXLo+VNOISEo. Also, the voltage VDCe+VNOISEe maintained in the second capacitor Csb2 of the second subtractor 222*e* is offset by the voltage VDCo maintained in the first capacitor Csb1, leaving only the second difference VNOISEe.

In the third operation process explained with reference to FIGS. 16 and 17, voltage offsetting occurs between the first capacitor Csb1 and the second capacitor Csb2.

The first difference VPXLo+VNOISEo outputted from the first subtractor 222*o* has the sensing voltage VPXLo corresponding to the sensing current IPXL and the noise voltage VNOISEo corresponding to the first noise component. Hence, the first difference VPXLo+VNOISEo can be expressed as "VPXLo+VNOISEo=ΔoV". The second difference VNOISEe outputted from the second subtractor 222*e* only has the noise voltage VNOISEe corresponding to the second noise component. Hence, the second difference VNOISEe can be expressed as "VNOISEe=ΔeV".

The first and second differences ΔoV and ΔeV delivered to the first and second input terminals of the scaler 230 undergo a differencing process afterwards. By performing a differencing process, "VNOISEo" and "VNOISEe" corresponding to the noise components are respectively removed from "VPXLo+VNOISEo" included in the first difference ΔoV and "VNOISEe" included in the second difference ΔeV, thus leaving the sensing voltage VPXLo corresponding to the sensing current IPXLo. Accordingly, in the second exemplary embodiment, the sensing capability can be enhanced enough to allow for relatively precise sensing even if the amount of sensing current decreases as the driving TFT gets smaller in size. Moreover, the second exemplary embodiment can eliminate or improve the effects of noise components that may be introduced during a sensing operation.

As explained above, the present invention can enhance low-current sensing capability since a current source for applying a large current which is higher than a sensing current and a subtractor for taking only the sensing current, but not an artificially applied current, are formed inside a data driver IC. Moreover, the present invention can eliminate or improve the effects of noise components that may be introduced during a sensing operation, by differencing sensing values obtained through two channels.

It will be apparent to those skilled in the art that various modifications and variations can be made in the present disclosure without departing from the technical idea or scope of the disclosure. Thus, it is intended that the present disclosure cover the modifications and variations of this disclosure provided they come within the scope of the appended claims and their equivalents.

What is claimed is:

1. A sensing circuit, comprising:

a current source configured to output a direct current;

a first integrator configured to integrate a first direct current, sensing current, and first noise component applied through a first sensing channel to output a first direct current voltage, a sensing voltage, and a first noise voltage, the first direct current being higher than the sensing current;

a second integrator configured to integrate a second direct current and second noise component applied through a second sensing channel to output a second direct current voltage and a second noise voltage, the second direct current being higher than the sensing current;

a first subtractor configured to:

store the first direct current voltage outputted during a first operation time of the first integrator in a first capacitor; and store the sum of the first direct current voltage, sensing voltage, and first noise voltage outputted during a second operation time of the first integrator in a second capacitor; and a second subtractor configured to:

store the second direct current voltage outputted during a first operation time of the second integrator in a third capacitor; and store the sum of the second direct current voltage and second noise voltage outputted during a second operation time of the second integrator in a fourth capacitor.

2. The sensing circuit of claim 1, wherein the first subtractor comprises:

a first capacitor configured to store the direct current voltage;

a second capacitor configured to store the sensing voltage and the direct current voltage; and a plurality of switches configured to perform a switching operation to subtract the voltages stored in the first capacitor and second capacitor.

3. The sensing circuit of claim 2, wherein the first subtractor comprises:

a first switch, one end of which is connected to an output terminal of the integrator, and the other end of which is connected to a first electrode of the first capacitor;

a second switch, one end of which is connected to the output terminal of the integrator, and the other end of which is connected to a first electrode of the second capacitor;

the first capacitor, the first electrode of which is connected to the other end of the first switch and, a second electrode of which is connected to a second electrode of the second capacitor;

the second capacitor, the first electrode of which is connected to the other end of the second switch, and the second electrode of which is connected to the second electrode of the first capacitor;

a third switch, one end of which is connected to the second electrode of the first capacitor and the second electrode of the second capacitor, and the other end of which is connected to a first reference voltage source of the subtractor; and a fourth switch, one end of which is connected to the first electrode of the first capacitor, and the other end of which is connected to a second reference voltage source of the subtractor.

4. The sensing circuit of claim 1, wherein:

the first subtractor is further configured to take the sensing voltage and the first noise voltage from the first and second capacitors, but not the first direct current voltage; and the second subtractor is further configured to take the second noise voltage from the third and fourth capacitors, but not the second direct current voltage.

5. A data driver integrated circuit (IC), comprising:

a voltage supply part configured to output a data voltage for display or a data voltage for sensing through a data channel; and a sensing circuit configured to sense a current through a sensing channel, the sensing circuit comprising:

a current source configured to output a direct current;

a first integrator configured to integrate a first direct current, sensing current, and first noise component applied through a first sensing channel to output a first direct current voltage, a sensing voltage, and a first noise voltage, the first direct current being higher than the sensing current;

a second integrator configured to integrate a second direct current and second noise component applied through a second sensing channel to output a second direct current voltage and a second noise voltage, the second direct current being higher than the sensing current;

a first subtractor configured to:

store the first direct current voltage outputted during a first operation time of the first integrator in a first capacitor; and store the sum of the first direct current voltage, sensing voltage, and first noise voltage outputted during a second operation time of the first integrator in a second capacitor; and a second subtractor configured to:

store the second direct current voltage outputted during a first operation time of the second integrator in a third capacitor; and store the sum of the second direct current voltage and second noise voltage outputted during a second operation time of the second integrator in a fourth capacitor.

6. The data driver IC of claim 5, wherein the first subtractor comprises:

a first capacitor configured to store the first direct current voltage;

a second capacitor configured to store the sensing voltage and the first direct current voltage; and a plurality of switches configured to a switching operation to subtract the voltages stored in the first capacitor and second capacitor.

7. The data driver IC of claim 6, wherein the first subtractor comprises:

a first switch, one end of which is connected to an output terminal of the first integrator, and the other end of which is connected to a first electrode of the first capacitor;

a second switch, one end of which is connected to the output terminal of the first integrator, and the other end of which is connected to a first electrode of the second capacitor;

the first capacitor, the first electrode of which is connected to the other end of the first switch and, a second electrode of which is connected to a second electrode of the second capacitor;

the second capacitor, the first electrode of which is connected to the other end of the second switch, and the second electrode of which is connected to the second electrode of the first capacitor;

a third switch, one end of which is connected to the second electrode of the first capacitor and the second electrode of the second capacitor, and the other end of which is connected to a first reference voltage source of the first subtractor; and a fourth switch, one end of which is connected to the first electrode of the first capacitor, and the other end of which is connected to a second reference voltage source of the first subtractor.

8. The data driver IC of claim 5, wherein the data driver IC is further configured to:

take the sensing voltage and the first noise voltage from the first and second capacitors, but not the first direct current voltage; and takes the second noise voltage from the third and fourth capacitors, but not the second direct current voltage.

9. A display device, comprising:

a display panel comprising a plurality of pixels connected to sensing lines; and a data driver IC comprising:

sensing channels connected to the sensing lines; and a sensing circuit, the sensing circuit comprising:

a first integrator configured to integrate a first direct current, sensing current, and first noise component applied through a first sensing channel to output a first direct current voltage, a sensing voltage, and a first noise voltage, the first direct current being higher than the sensing current;

a second integrator configured to integrate a second direct current and second noise component applied through a second sensing channel to output a second direct current voltage and a second noise voltage, the second direct current being higher than the sensing current;

a first subtractor configured to:

store the first direct current voltage outputted during a first operation time of the first integrator in a first capacitor; and store the sum of the first direct current voltage, sensing voltage, and first noise voltage outputted during a second operation time of the first integrator in a second capacitor; and a second subtractor configured to:

store the second direct current voltage outputted during a first operation time of the second integrator in a third capacitor; and store the sum of the second direct current voltage and second noise voltage outputted during a second operation time of the second integrator in a fourth capacitor.

10. The display device of claim 9, wherein the first subtractor comprises:

a first capacitor configured to store the first direct current voltage;

a second capacitor configured to store the sensing voltage and the first direct current voltage; and a plurality of switches configured to perform a switching operation to subtract the voltages stored in the first capacitor and second capacitor.

11. The display device of claim 10, wherein the first subtractor comprises:

a first switch, one end of which is connected to an output terminal of the first integrator, and the other end of which is connected to a first electrode of the first capacitor;

a second switch, one end of which is connected to the output terminal of the first integrator, and the other end of which is connected to a first electrode of the second capacitor;

the first capacitor, the first electrode of which is connected to the other end of the first switch and, a second electrode of which is connected to a second electrode of the second capacitor;

the second capacitor, the first electrode of which is connected to the other end of the second switch, and the second electrode of which is connected to the second electrode of the first capacitor;

a third switch, one end of which is connected to the second electrode of the first capacitor and the second electrode of the second capacitor, and the other end of which is connected to a first reference voltage source of the first subtractor; and a fourth switch, one end of which is connected to the first electrode of the first capacitor, and the other end of which is connected to a second reference voltage source of the first subtractor.

12. The display device of claim 11, wherein the first reference voltage source and the second reference voltage source have different levels from each other.

13. The display device of claim 9, wherein the data driver IC is configured to:

take the sensing voltage and the first noise voltage from the first and second capacitors, but not the first direct current voltage; and take the second noise voltage from the third and fourth capacitors, but not the second direct current voltage.

14. The display device of claim 12, wherein the data driver IC is configured to obtain the sensing voltage by differencing the sensing voltage and first noise voltage taken from the first subtractor and the second noise voltage.

15. A method of driving a display device, the method comprising:

integrating a first direct current applied through a first sensing channel by a first integrator to output a first direct current voltage and store the first direct current voltage outputted from the first integrator in a first capacitor of a first subtractor, and integrating a second direct current applied through a second sensing channel by a second integrator to output a second direct current voltage and store the second direct current voltage outputted from the second integrator in a first capacitor of a second subtractor;

integrating the first direct current, a sensing current, and a first noise component, which are applied through the first sensing channel, by the first integrator to output the sum of the first direct current voltage, a sensing voltage, and a first noise voltage and store the sum of the first direct current voltage, sensing voltage, and first noise voltage outputted from the first integrator in a second capacitor of the first subtractor, and integrating the second direct current and a second noise component, which are applied through the second sensing channel, by the second integrator to output the second direct current voltage and a second noise voltage and store the second direct current voltage and second noise voltage outputted from the second integrator in a second capacitor of the second subtractor; and taking the sensing voltage and the first noise voltage from the first and second capacitors of the first subtractor, but not the first direct current voltage, and taking the second noise voltage from the first and second capacitors of the second subtractor, but not the second direct current voltage.

16. The method of claim 15, further comprising obtaining the sensing voltage by differencing the sensing voltage and first noise voltage taken from the first subtractor and the second noise voltage.

* * * * *